US008657464B2

(12) United States Patent
Lundberg et al.

(10) Patent No.: US 8,657,464 B2
(45) Date of Patent: Feb. 25, 2014

(54) MULTIPLE MODE LIGHT EMITTING DEVICE

(75) Inventors: John Lundberg, Springfield, OH (US); Bo Stout, Springfield, OH (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/287,744

(22) Filed: Nov. 2, 2011

(65) Prior Publication Data

US 2013/0107513 A1 May 2, 2013

(51) Int. Cl.

| | |
|---|---|
| ***F21V 14/02*** | (2006.01) |
| ***F21V 14/04*** | (2006.01) |
| ***F21V 14/06*** | (2006.01) |
| ***F21V 17/02*** | (2006.01) |

(52) U.S. Cl.

USPC ..... 362/232; 362/35; 362/238; 362/249.03; 362/294; 362/324

(58) Field of Classification Search

USPC ..... 362/277, 282, 284, 319, 322, 324, 449, 362/245, 281, 283, 35, 249.02–249.03, 362/249.05–249.07, 230–232, 235–238; 40/502, 433, 431

See application file for complete search history.

(56) References Cited

U.S. PATENT DOCUMENTS

| | | | | |
|---|---|---|---|---|
| 2,079,732 | A | 5/1937 | Conley | |
| 5,038,258 | A * | 8/1991 | Koch et al. | 362/237 |
| 6,149,283 | A * | 11/2000 | Conway et al. | 362/236 |
| 6,357,893 | B1 * | 3/2002 | Belliveau | 362/285 |
| 6,454,437 | B1 * | 9/2002 | Kelly | 362/246 |
| 6,474,837 | B1 | 11/2002 | Belliveau | |
| 7,604,361 | B2 * | 10/2009 | Pohlert et al. | 362/9 |
| 7,874,701 | B2 * | 1/2011 | Pohlert et al. | 362/277 |
| 7,963,683 | B2 * | 6/2011 | Czajkowski et al. | 362/517 |
| 2005/0225980 | A1 * | 10/2005 | Amphlett | 362/244 |
| 2005/0265024 | A1 * | 12/2005 | Luk | 362/231 |
| 2006/0002109 | A1 * | 1/2006 | Imade | 362/231 |

FOREIGN PATENT DOCUMENTS

WO 2004047498 A1 6/2004

OTHER PUBLICATIONS

PCT Publication, Spartano, Lighting Device.*

(Continued)

*Primary Examiner* — Diane Lee
*Assistant Examiner* — Naomi M Wolford
(74) *Attorney, Agent, or Firm* — Ingrassia Fisher & Lorenz, P.C.

(57) ABSTRACT

Methods and systems of emitting different light from a multiple mode light emitting device are disclosed. An exemplary embodiment has a LED portion with a plurality of first LEDs and a plurality of second LEDs arranged in a first ring centered about a central axis, and a rotatable portion with a plurality of light conditioning elements arranged in a second ring centered about the central axis. The plurality of first LEDs emit and the plurality of second LEDs emit different types of light. Each light conditioning element receives and conditions light from one of the plurality of first LEDs when the light conditioning element is in a first position. Each light conditioning element receives and conditions light from one of the plurality of second LEDs when the light conditioning element is in a second position. The light conditioning elements may be reflector cups or may be lens.

20 Claims, 4 Drawing Sheets

(56) References Cited

U.S. PATENT DOCUMENTS

| | | | | |
|---|---|---|---|---|
| 2009/0268458 | A1 | 10/2009 | Feinbloom et al. | |
| 2010/0301779 | A1 * | 12/2010 | Spartano et al. | 315/320 |
| 2011/0116260 | A1 * | 5/2011 | Kretschmann | 362/231 |
| 2012/0224364 | A1 * | 9/2012 | Mizuta et al. | 362/231 |

OTHER PUBLICATIONS

EP Search Report for Application No. EP 12 190 452.8 dated Oct. 17, 2013.

EP Office Action for Application No. EP 12 190 452.8 dated Oct. 31, 2013.

* cited by examiner

MULTIPLE MODE LIGHT EMITTING DEVICE

BACKGROUND OF THE INVENTION

Lighting devices are increasingly employing light emitting diodes (LEDs) to generate light. The lighting devices may be used for warning lights, flood lights, spotlights, or the like. Such lighting devices may be mounted on structures or vehicles. Or, such lighting devices may be hand held.

LEDs may be fabricated so as to emit visible light, such as white light or colored light. Some LEDs may be configured to emit non-visible light, such as infrared (IR), ultra-violet (UV) or the like.

Light emitted by the LEDs may be directed in a desired direction using reflectors. Additionally, or alternatively, the light emitted by the LEDs may be conditioned and/or focused using a lens or the like.

Some lighting devices may use different types of LEDs at different times such that different light may be separately emitted. For example, a plurality of red colored LEDs and yellow colored LEDs may be disposed in a single lighting device. When the red colored LEDs are on, then red colored light is emitted from the lighting device. At other times, when the yellow colored LEDs are on (and the red colored LEDs are off), then yellow colored light is emitted from the lighting device.

Size of the lighting device is, in some applications, very important. Accordingly, it is desirable to have a relatively smaller LED-based lighting device that is configured to emit different types of light. However, the reflectors and/or lens for each individual LED are typically larger than the LED itself. Accordingly, overall size of the lighting device is, to some extent, limited by the reflectors and/or lens associated with individual LEDs.

Accordingly, there is a continuing need to reduce size of lighting devices that emit different types of light from different types of LEDs.

SUMMARY OF THE INVENTION

An exemplary embodiment emits different types of light from a plurality of first LEDs and a plurality of second LEDs. An exemplary embodiment has a LED portion with the plurality of first LEDs and plurality of second LEDs arranged in a first ring centered about a central axis, and a rotatable portion with a plurality of light conditioning elements arranged in a second ring centered about the central axis. Each light conditioning element receives and conditions light from one of the plurality of first LEDs when the light conditioning element is in a first position. Each light conditioning element receives and conditions light from one of the plurality of second LEDs when the light conditioning element is in a second position. The light conditioning elements may be reflector cups or may be lenses.

BRIEF DESCRIPTION OF THE DRAWINGS

Preferred and alternative embodiments are described in detail below with reference to the following drawings.

DETAILED DESCRIPTION OF THE PREFERRED EMBODIMENT

Embodiments of the multiple mode light emitting device 100 may be implemented using different types of LED devices, or other types of relatively small light emitting devices, that are configured to emit different types of light. Each type of LEDs (or other light emitting devices) emit light of different frequencies in the visible or non-visible spectrum. Thus, when the different types of LEDs (or other light emitting devices) emit visible light, the emitted light will be of a different color. As another example, infrared (IR) or ultraviolet (UV) light may be emitted from the multiple mode light emitting device 100.

A LED portion holds a plurality of LEDs arranged in one or more concentric circles about a central axis of the multiple mode light emitting device 100. At least one rotatable portion is included with a plurality of light conditioning elements also arranged in corresponding rings centered about the central axis of the multiple mode light emitting device 100. The ring of the plurality of light conditioning elements have the same diameter as the ring of alternating LEDs. When the rotatable portion is in a first position, each light conditioning element receives and conditions light from one of a plurality of first LEDs of the same type. When the rotatable portion is in rotated to a second position, each light conditioning element receives and conditions light from one of a plurality of second LEDs of a different type.

Figure 1:
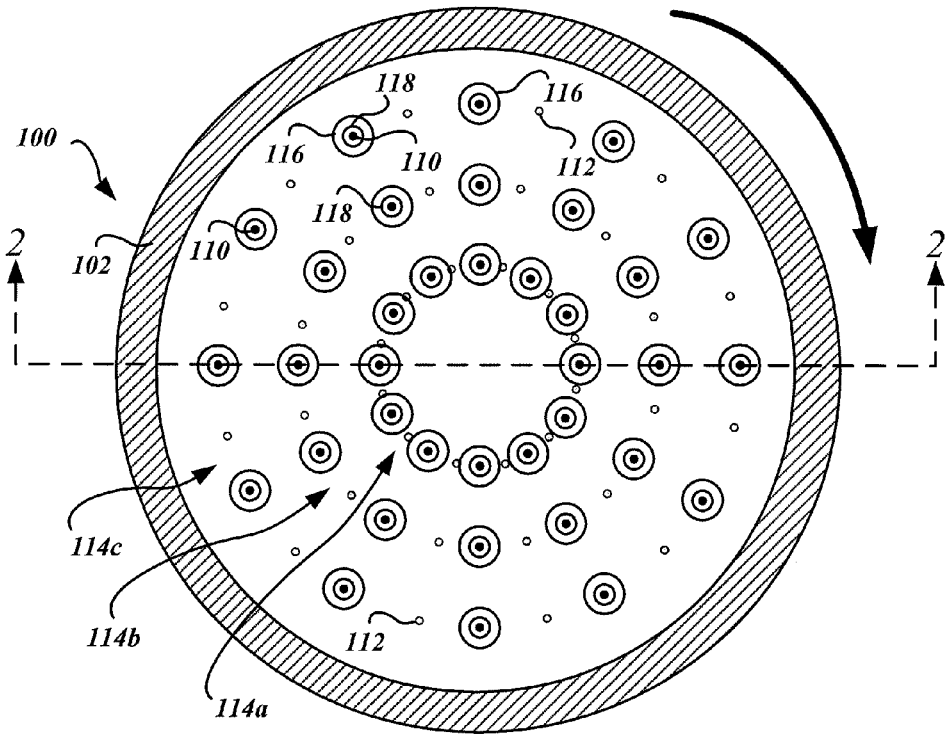
FIG. 1 is a top view of the light output surface of an exemplary embodiment of a multiple mode light emitting device.
Figure 2:
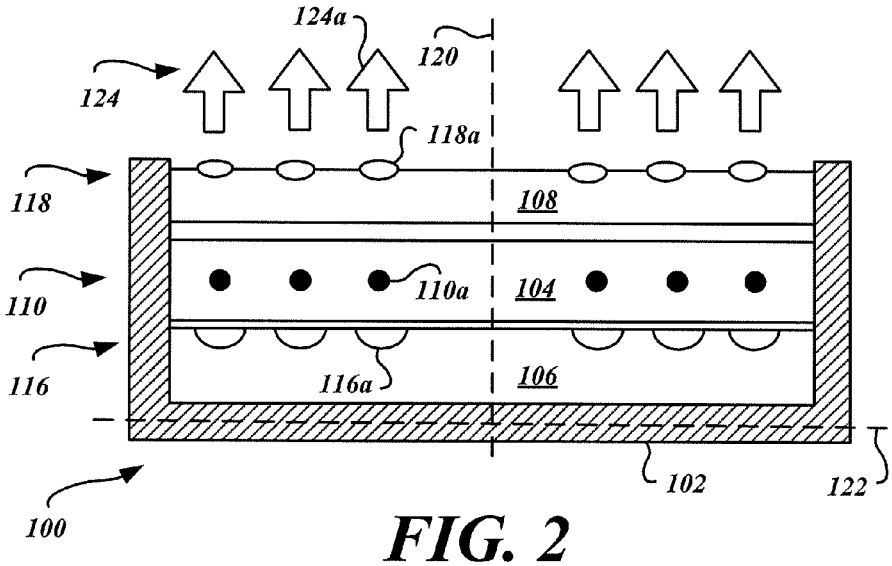
FIG. 2 is a side view of the multiple mode light emitting device.

FIG. 1 is a view of the light output surface of an exemplary embodiment of a multiple mode light emitting device 100. FIG. 2 is a side view of the multiple mode light emitting device 100. The exemplary embodiment of the multiple mode light emitting device 100 comprises housing 102 with a LED portion 104, an optional reflector portion 106, and an optional lens portion 108 affixed therein. Other components, not shown, may be included.

The LED portion 104 comprises a plurality of first LEDs 110 operating in an "on" state (conceptually illustrated as black shaded circles) and a plurality of second LEDs 112 operating in an "off" state (conceptually illustrated as grey shaded circles). The plurality of first LEDs 110 emit a first type of light. The plurality of second LEDs 112 emit a second type of light that is different from the type of light emitted by the plurality of first LEDs 110. The emitted light may be visible light that is white or is colored. The emitted light may be non-visible, such as IR or UV light.

In the exemplary embodiment illustrated in FIG. 1, the plurality of first LEDs 110 are arranged in three concentric rings, 114*a*, 114*b* and 114*c* on or in the LED portion 104. The three concentric rings, 114*a*, 114*b* and 114*c* are oriented about the central axis 120. Adjacent to each of the plurality of first LEDs 110 is one of the plurality of second LEDs 112. In alternative embodiments, any suitable number of concentric rings 114 may be used. For example, a single concentric ring of alternating ones of the plurality of first LEDs 110 and the plurality of second LEDs 112 may be used, such as when the multiple mode light emitting device 100 is used as a hand-held light. As another non-limiting example, more than three concentric rings may be used, such as when the multiple mode light emitting device 100 is used as a large search light or flood light.

The reflector portion 106 comprises a plurality of reflector cups 116 that receive and condition the light by reflecting light is a desired direction and/or focusing the light. The number of reflector cups 116 corresponds to the number of the plurality of first LEDs 110 (and consequently, corresponds to the number of plurality of second LEDs 112). The plurality of reflector cups 116 are arranged in concentric rings having the same diameter as the concentric rings, 114*a*, 114*b* and 114*c* such that when the reflector portion 106 is in a first position, each of the reflector cups 116 are oriented behind a corresponding one of the plurality of first LEDs 110. When the reflector portion 106 is rotated about a central axis 120 to a second position, each of the reflector cups 116 are oriented behind a corresponding one of the plurality of second LEDs 112.

In the example embodiment illustrated in FIG. 1, the reflector portion 106 is disposed behind the LED portion 104. Thus, the LED portion 104 may comprise a transparent body which holds the plurality of first LEDs 110 and the plurality of second LEDs 112. Alternatively, the LED portion 104 may be disposed behind the reflector portion 106. Thus, the LED portion 104 may comprise a plurality of posts for the like which extend the plurality of first LEDs 110 and the plurality of second LEDs 112 through holes or the like in the reflector portion 106. In such embodiments, angular rotation of the reflector portion 106 is facilitated by slots disposed in the reflector portion 106.

The optional lens portion 108 comprises a plurality of lenses 118 that receive and condition the light. For example, the lenses 118 may focus light, filter the light, modify a polarity of the light, or the like. The number of lenses 118 corresponds to the number of the plurality of first LEDs 110 (and consequently, corresponds to the number of plurality of second LEDs 112). The plurality of lenses 118 are arranged in concentric rings having the same diameter as the concentric rings, 114*a*, 114*b* and 114*c* such that when the lens portion 108 is in a first position, each of the lenses 118 are oriented in front of a corresponding one of the plurality of first LEDs 110. When the lens portion 108 is rotated about the central axis 120 to a second position, each of the lenses 118 are oriented in front of a corresponding one of the plurality of second LEDs 112.

For clarity of conceptually describing and illustrating the example embodiment of the multiple mode light emitting device 100, the reflector cups 116 are illustrated as having a larger diameter than the diameter of the lenses 118. The diameters of the reflector cups 116 and the lenses 118 may be of any suitable size. Further, the reflector cups 116 and or lenses 118 may have any suitable shape and/or orientation. In the example embodiment, the plurality of first LEDs 110, the plurality of second LEDs 112, the reflector cups 116 and the lenses 118 are illustrated in a planar orientation (flat) orthogonal to a horizontal axis 122 of the multiple mode light emitting device 100.

When operating in a first mode, all of the plurality of first LEDs 110 are powered ("on") and emit a first type of light 124. If the optional reflector portion 106 is included, the reflector portion 106 is oriented in the first position so that each of the reflector cups 116 are disposed below the powered plurality of first LEDs 110. Similarly, if the optional lens portion 108 is included, the lens portion 108 is oriented in the first position so that each of the lenses 118 are disposed in front of the powered plurality of first LEDs 110. For example, the reflector cup 116*a* and the lens 118*a* condition the output light 124*a* emitted by the LED 110*a*.

Figure 3:
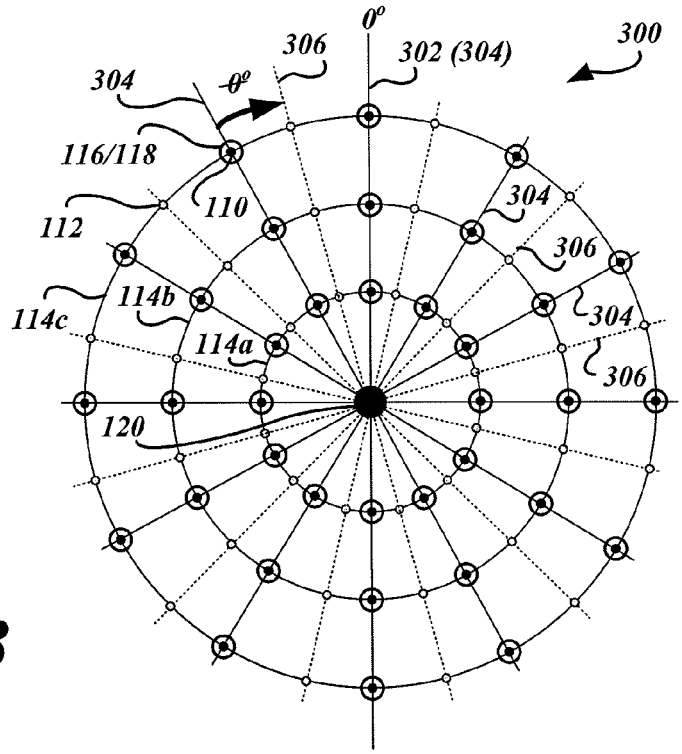
FIG. 3 is a top view of an exemplary multiple mode light emitting device referenced to a polar coordinate system when the plurality of first LEDs are operated.
Figure 4:
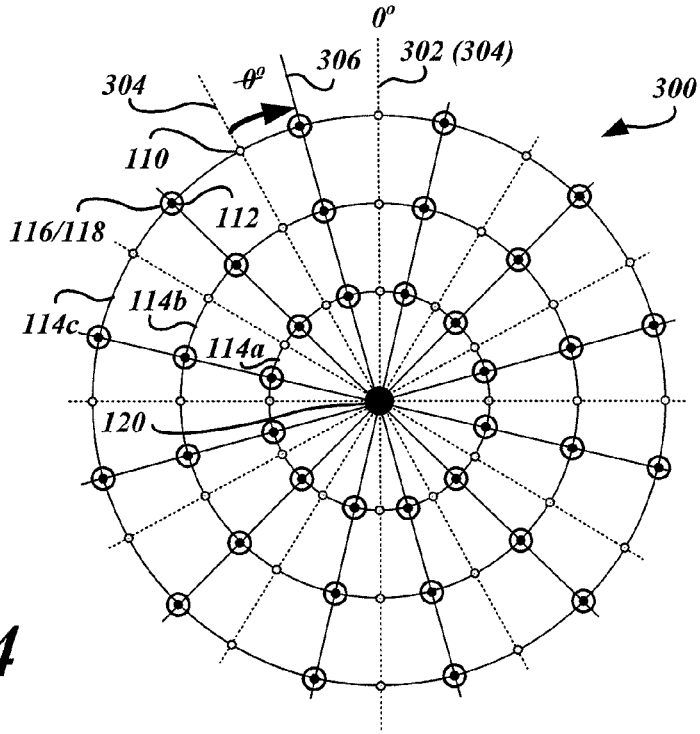
FIG. 4 is a top view of an exemplary multiple mode light emitting device referenced to a polar coordinate system when the plurality of second LEDs are operated.

FIG. 3 is a top view of an exemplary multiple mode light emitting device 100 referenced to a polar coordinate system 300 when the plurality of first LEDs 110 are operated. FIG. 4 is a top view of the exemplary multiple mode light emitting device 100 referenced to the polar coordinate system 300 when the plurality of second LEDs 112 are operated. The concentric rings 114*a*, 114*b*, 114*c* are denoted with a sold lined circle centered about the central axis 120.

In FIG. 3, the plurality of first LEDs 110 are each illustrated as black shaded circles (to denote a powered "on" state) and the plurality of second LEDs 112 are each illustrated was grey shaded circles (to denote a powered "off" state). Also, one of the reflector cups 116 or one of the lenses 118 (identified with reference numeral 116/118) is illustrated. In FIG. 3, the illustrated reflector cups 116 or lenses 118 are illustrated as being oriented so as to condition light emitted by the plurality of first LEDs 110.

In FIG. 4, the plurality of second LEDs 112 are each illustrated as black shaded circles (to denote a powered "on" state) and the plurality of first LEDs 110 are each illustrated was grey shaded circles (to denote a powered "off" state). One of the reflector cups 116 or one of the lenses 118 (identified with reference numeral 116/118) are illustrated as being oriented so as to condition light emitted by the plurality of second LEDs 112.

The plurality of first LEDs 110 and the plurality of second LEDs 112 are arranged in an alternating fashion along the concentric rings 114*a*, 114*b*, 114*c*. In the exemplary embodiment with three concentric rings, the plurality of first LEDs 110 are arranged along a series of radial lines 302, wherein each one of the plurality of first LEDs 110 are located at the intersection of its respective concentric ring and its respective radial line 302. Similarly, the plurality of second LEDs 112 are arranged along a series of radial lines 304, wherein each one of the plurality of second LEDs 112 are located at the intersection of its respective concentric ring and its respective radial line 304. Each of the radial lines 302, extending outward from and orthogonal to the central axis 120, are separated from a corresponding adjacent radial line 304 by an angular displacement, shown as Ø°.

When the plurality of first LEDs 110 are operating in the "on" state, the reflector cups 116 and/or the lenses 118 are oriented along the radial lines 304 associated with the plurality of first LEDs 110, as illustrated in FIG. 3. In this operating mode, the reflector portion 106 and/or the lens portion 108 is in a first position. When the plurality of second LEDs 112 are operating in the "on" state, the reflector cups 116 and/or the lenses 118 are oriented along the radial lines 306 associated with the plurality of second LEDs 112, as illustrated in FIG. 4. In this operating mode, the reflector portion 106 and/or the lens portion 108 is in a second position.

In operation, when the plurality of second LEDs 112 are powered on (and the plurality of first LEDs 110 are powered off), the reflector portion 106 is rotated about the central axis 120 of the multiple mode light emitting device 100 by the angular displacement Ø° to move from its first position to its second position. Similarly, the lens portion 108 is rotated about the central axis 120 of the multiple mode light emitting device 100 by the angular displacement Ø° to move from its first position to its second position. For clarity, the reflector portion 106 and/or the lens portion 108 are illustrated as being rotated in a clockwise direction. Alternatively, or additionally, the reflector portion 106 and/or the lens portion 108 are illustrated as being rotated in a counterclockwise direction.

When the plurality of first LEDs 110 are next powered on (and the plurality of second LEDs 112 are powered off), the reflector portion 106 is rotated about the central axis 120 of the multiple mode light emitting device 100 by the angular displacement Ø° to move from its second position back to its first position. Similarly, the lens portion 108 is rotated about the central axis 120 of the multiple mode light emitting device 100 by the angular displacement Ø° to move from its second position back to its first position.

In some embodiments, the angular displacement (Ø°) between all adjacent radial lines are the same. In such embodiments, rotation of the reflector portion 106 and/or the lens portion 108 may continue each time in the clockwise direction (or in the counterclockwise direction) where the amount of angular rotation at each increment equals the angular displacement (Ø°).

Figure 5:
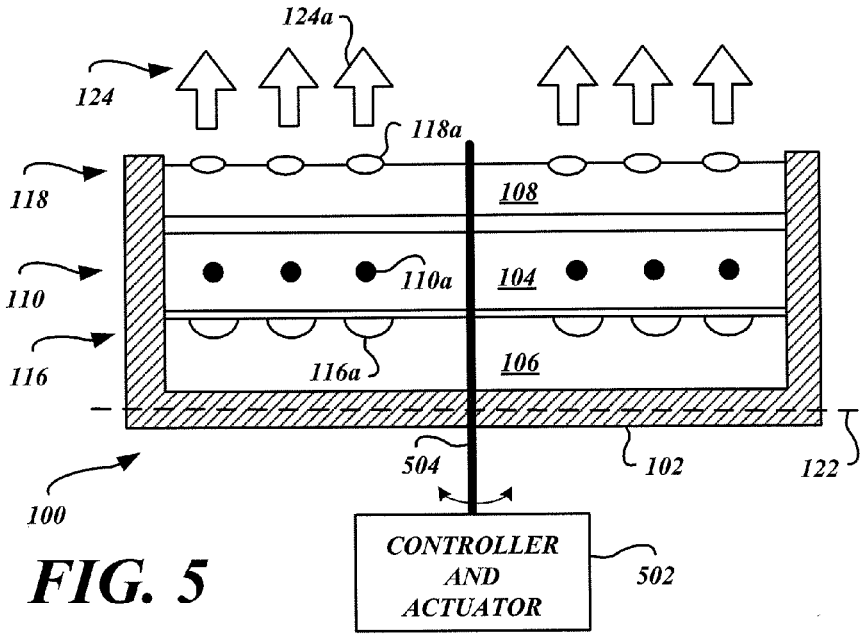
FIG. 5 is a diagram of an exemplary embodiment of the multiple mode light emitting device showing a controller and actuator unit that rotates a shaft oriented along the central axis.

FIG. 5 is a diagram of an exemplary embodiment of the multiple mode light emitting device 100 showing a controller and actuator unit 502 that rotates a shaft 504 oriented along the central axis 120. The reflector portion 106 and/or the lens portion 108 are affixed to, or are otherwise engaged with, the shaft 504. When power is provided to the plurality of first LEDs 110, the controller and actuator unit 502 rotates the shaft 504 so that the reflector portion 106 and/or the lens portion 108 is moved to their respective first position. When power is provided to the plurality of second LEDs 112, the controller and actuator unit 502 rotates the shaft 504 so that the reflector portion 106 and/or the lens portion 108 is moved to their respective second position.

Figure 6:
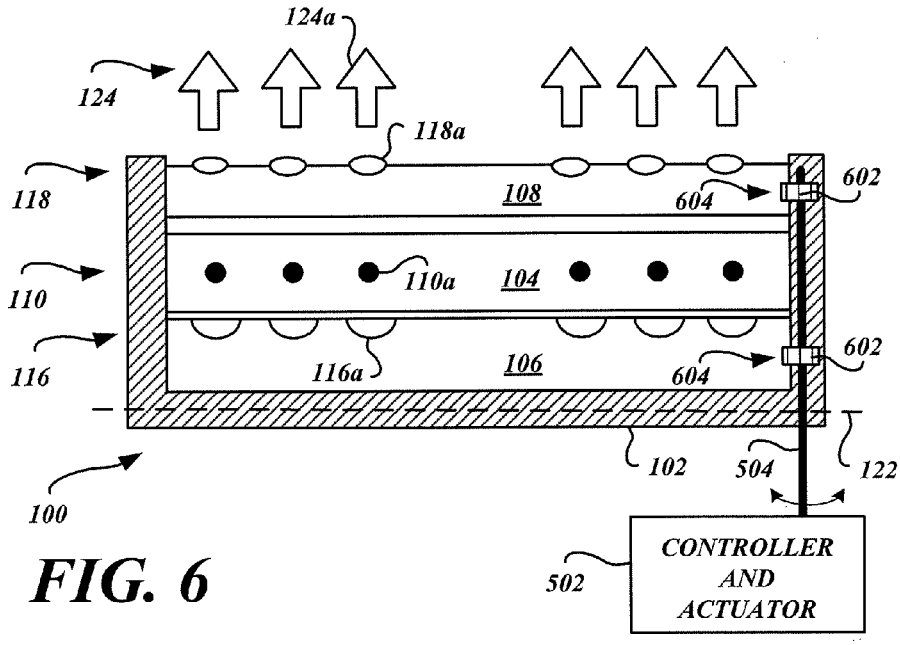
FIG. 6 is a diagram of an exemplary embodiment of the multiple mode light emitting device showing a controller and actuator unit that rotates a shaft disposed along the edge of the housing.

FIG. 6 is a diagram of an exemplary embodiment of the multiple mode light emitting device 100 showing a controller and actuator unit that rotates the shaft 504 disposed along the edge of the housing 102. Gears 602 or another frictional device are affixed to the shaft 504. The gears 602 engage teeth disposed along the edges 604 of the reflector portion 106 and/or the lens portion 108. When power is provided to the plurality of first LEDs 110, the controller and actuator unit 502 rotates the shaft 504 so that the reflector portion 106 and/or the lens portion 108 is moved to their respective first position. When power is provided to the plurality of second LEDs 112, the controller and actuator unit 502 rotates the shaft 504 so that the reflector portion 106 and/or the lens portion 108 is moved to their respective second position.

In some embodiments, the reflector portion 106 and/or the lens portion 108 is a servomotor-based device. Accordingly, the controller and actuator unit 502 may adjust position of the reflector portion 106 and/or the lens portion 108 to any desired position. In some embodiments, a spring or other mechanism may be used to set the reflector portion 106 and/or the lens portion 108 to the first position, and a solenoid or the like may be used to rotate the reflector portion 106 and/or the lens portion 108 to the second position. In yet other embodiments, a solenoid or the like may be used to move a lever arm or the like to rotate the reflector portion 106 and/or the lens portion 108.

Figure 7:
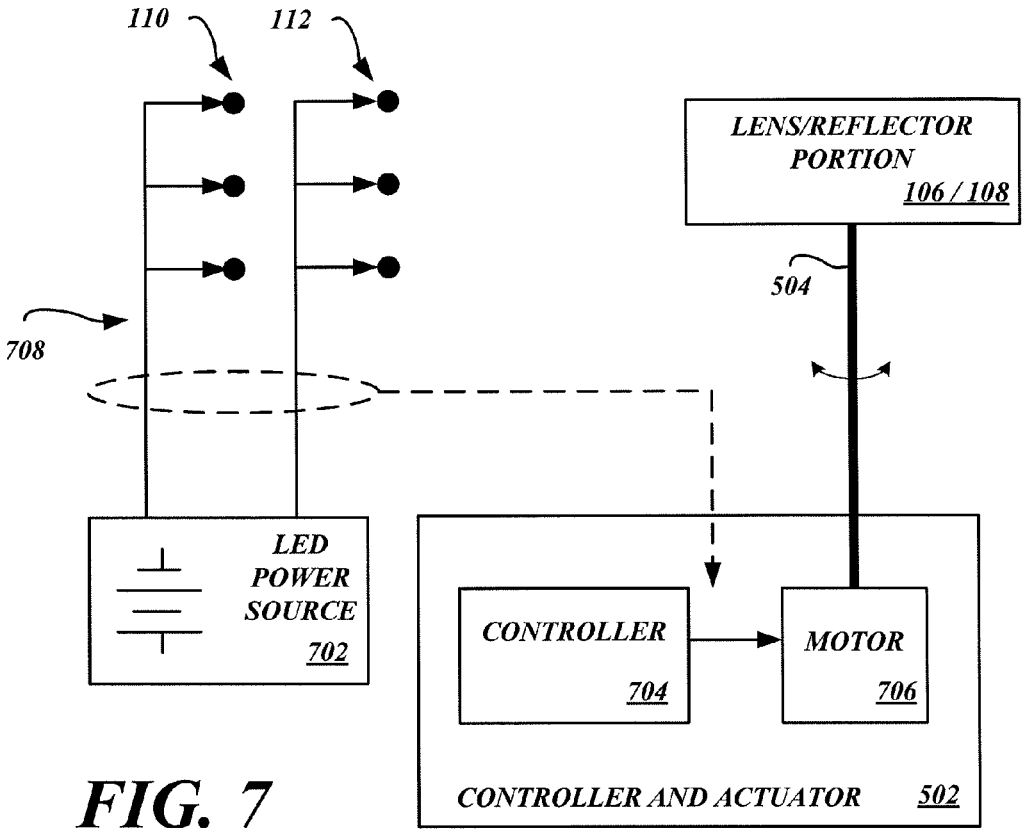
FIG. 7 is a block diagram of the controller and actuator unit of an exemplary embodiment of the multiple mode light emitting device.

FIG. 7 is a block diagram of an example controller and actuator unit 502 of an exemplary embodiment of the multiple mode light emitting device 100. A LED power source 702 is configured to provide power to the plurality of first LEDs 110, and to alternatively provide power to the plurality of second LEDs 112. The selection to power the plurality of first LEDs 110 or the plurality of second LEDs 112 may be based on a user input or may be based on an automatic input based on a current operating condition. For example, if the plurality of first LEDs 110 emit visible white light at night time, and if the plurality of second LEDs 112 emit IR light when the vehicle is operating in a covert mode, then the selection of outputting white light or IR light may be based on the selected mode of vehicle operation (non-covert mode and covert mode during night operation).

The example controller and actuator unit 502 comprises a controller 704 and a motor 706. The controller 704 determines the operating mode of the multiple mode light emitting device 100 based on whether the plurality of first LEDs 110 or the plurality of second LEDs 112 are receiving power from the LED power source 702. Some embodiments may sense the current and/or voltage state on the connectors 708 to determine which of the plurality of first LEDs 110 or the plurality of second LEDs 112 are powered on. Other embodiments may receive a control signal from one or more devices on the connectors 708, from one or more devices in the LED power source 702, or from other components or systems.

In this example embodiment, the controller 704 provides a control signal, power signal, or the like to the motor 706. The motor then operates to rotate the reflector portion 106 and/or the lens portion 108 to the first position when the plurality of first LEDs 110 are powered, and to rotate the reflector portion 106 and/or the lens portion 108 to the second position when the plurality of second LEDs 112 are powered.

The controller 704, in an example embodiment, is implemented as firm ware. In other embodiments, a processor system (not shown) executes logic retrieved from a memory (not shown). In other embodiments, the controller 704 may operate other devices that control the position of the reflector portion 106 and/or the lens portion 108.

Figure 8:
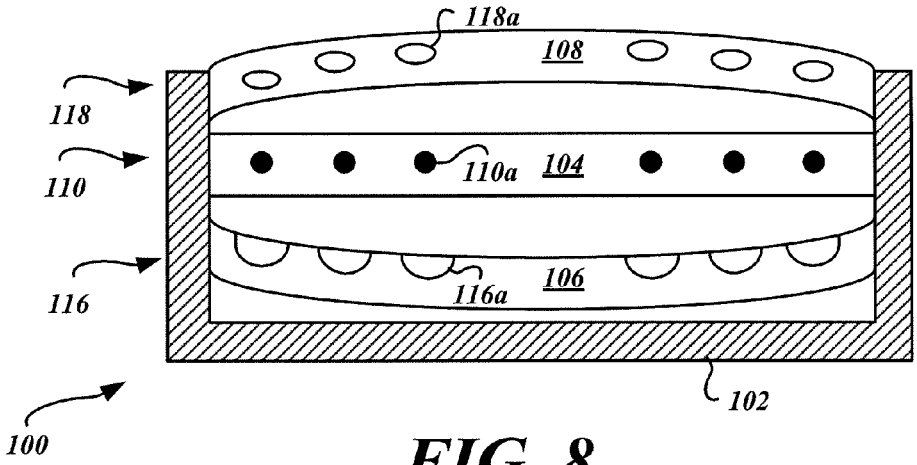
FIG. 8 is a side view of an alternative embodiment multiple mode light emitting device.

FIG. 8 is a side view of an alternative embodiment multiple mode light emitting device. In this example embodiment, the reflector portion 106 and/or the lens portion 108 are curvilinear. In other embodiments, the reflector portion 106 and/or the lens portion 108 may be fabricated in any suitable shape and/or size.

In an alternative embodiment, the position of the reflector portion 106 and/or the lens portion 108 may be manually adjustable by a user. An outer edge of the reflector portion 106 and/or the lens portion 108 may be accessible by the user. Alternatively, or additionally, a frictional surface may be accessible thereon that may then be gripped or otherwise frictionally engaged by the user's hand or fingers to manually rotate the reflector portion 106 and/or the lens portion 108. Such configurations may be particularly desirable when the multiple mode light emitting device 100 is a hand held type of device.

Some embodiments of the multiple mode light emitting device 100 comprise more than two types of LED lights or other suitable light emitting devices (visible or non-visible light). Any suitable number of different types of LEDs (or other light emitting devices) may be used by such embodiments. Each of the different types of LEDs (or other light emitting devices) are aligned along an associated radial line at the intersection of their respective concentric ring. An angular displacement $Ø°_i$, separates each radial line. The angular displacement $Ø°_i$, may be constant between radial lines, or may vary. In some embodiments, varying the angular displacement $Ø°_i$, permits different sizes of LEDs (or other light emitting devices).

For example, but not limited to, three types of light may be emitted by arranging three different plurality of LEDs (or other light emitting devices) in the housing 102. Each plurality of LEDs (or other light emitting devices) would be oriented in along one or more concentric rings and along one or more radial lines. In this embodiment, the reflector portion 106 and/or the lens portion 108 would be rotated to a first position to condition light emitted by a plurality of first LEDs, rotated to a second position to condition light emitted by a plurality of second LEDs, and rotated to a third position to condition light emitted by a third plurality of LEDs. Radial lines between the first and second types of LEDs (or other light emitting devices) would be separated by a first angular displacement $Ø°_1$. Radial lines between the second and third types of LEDs (or other light emitting devices) would be separated by a second angular displacement $Ø°_2$. Accordingly, when the position of the reflector portion 106 and/or the lens portion 108 is adjusted from the first to the second type of LEDs (or other light emitting devices), the amount of rotation corresponds to the first angular displacement $Ø°_1$. When the position of the reflector portion 106 and/or the lens portion 108 is adjusted from the second to the third type of LEDs (or other light emitting devices), the amount of rotation corresponds to the second angular displacement $Ø°_2$. When the position of the reflector portion 106 and/or the lens portion 108 is adjusted from the first to the third type of LEDs (or other light emitting devices), the magnitude of rotation corresponds to the sum of the first angular displacement $Ø°_1$ and the second angular displacement $Ø°_2$.

In some embodiments, the magnitude of emitted light may be adjustable by omitting selected LEDs (or other light emitting devices). That is, if the magnitude of light emitted by the plurality of second LEDs may be less if there are fewer of the plurality of second LEDs.

In an alternative embodiment, the LED portion 104 is rotated about the central axis while the reflector portion 106 and/or the lens portion 108 remain stationary.

While the preferred embodiment of the multiple mode light emitting device 100 has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A multiple mode light emitting device, comprising:

a light emitting diode (LED) portion comprising a plurality of first LEDs and a plurality of second LEDs arranged in a first ring centered about a central axis, wherein the plurality of first LEDs emit a first type of light and the plurality of second LEDs emit a second type of light that is different from the first type of light, wherein the first LEDs of the plurality of first LEDs and the second LEDs of the plurality of second LEDs are alternating with each other along the first ring, wherein each first LED of the plurality of first LEDs is aligned along one of a first plurality of radial lines extending outwardly from the central axis, wherein each second LED of the plurality of second LEDs is aligned along one of a second plurality of radial lines extending outwardly from the central axis, and wherein each second radial line is displaced from an adjacent first radial line by an angular displacement of Ø°; and a rotatable portion including a plurality of light conditioning elements arranged in a second ring centered about the central axis, wherein the second ring and the first ring have the same diameter, wherein the rotatable portion is configured to rotate between a first position and a second position, wherein rotation of the rotatable portion between the first and second positions rotates the plurality of light conditioning elements relative to the plurality of first LEDs and the plurality of second LEDs, wherein each light conditioning element receives and conditions light from one first LED of the plurality of first LEDs when the rotatable portion is in the first position, and wherein each light conditioning element receives and conditions light from one second LED of the plurality of second LEDs when the rotatable portion is in the second position, wherein the rotatable portion is rotated about the central axis by the angular displacement of Ø° to move between the first position and the second position.

2. The multiple mode light emitting device of claim 1, wherein the plurality of light conditioning elements comprises:

a plurality of reflector cups, wherein each reflector cup receives and reflects light from one first LED of the plurality of first LEDs when the rotatable portion is in the first position, and wherein each reflector cup receives and reflects light from one second LED of the plurality of second LEDs when the rotatable portion is in the second position.

3. The multiple mode light emitting device of claim 1, wherein the plurality of light conditioning elements comprises:

a plurality of lenses, wherein each lens receives and focuses light from one first LED of the plurality of first LEDs when the rotatable portion is in the first position, and wherein each lens receives and focuses light from one second LED of the plurality of second LEDs when the rotatable portion is in the second position.

4. The multiple mode light emitting device of claim 1, further comprising:

a controller and actuator unit, wherein the controller and actuator unit determines when the plurality of first LEDs are powered, and rotates the rotatable portion to the first position in response to determining the plurality of first LEDs are powered, and wherein the controller and actuator unit determines when the plurality of second LEDs are powered, and rotates the rotatable portion to the second position in response to determining the plurality of second LEDs powered.

5. The multiple mode light emitting device of claim 4, further comprising:

a shaft coupled to the rotatable portion and rotatable by the controller and actuator unit, wherein the controller and actuator unit rotates the shaft to rotate the rotatable portion to the first position in response to determining the plurality of first LEDs are powered, and wherein the controller and actuator unit rotates the shaft to rotate the rotatable portion to the second position in response to determining the plurality of second LEDs are powered.

6. The multiple mode light emitting device of claim 4, wherein the controller and actuator unit comprises:

a controller that determines when the plurality of first LEDs are powered and determines when the plurality of second LEDs are powered; and a motor controllably coupled to the controller and rotatably coupled to the shaft, wherein the motor rotates the shaft to rotate the rotatable portion to the first position in response to determining the plurality of first LEDs are powered, and wherein the motor rotates the shaft to rotate the rotatable portion to the second position in response to determining the plurality of second LEDs are powered.

7. The multiple mode light emitting device of claim 1, wherein the rotatable portion comprises:

an edge surface that is accessible by a user, wherein the user rotates the rotatable portion to the first position when the plurality of first LEDs are powered, and wherein the user rotates the rotatable portion to the second position when the plurality of second LEDs are powered.

8. The multiple mode light emitting device of claim 1, wherein the plurality of first LEDs is a first plurality of first LEDs, wherein the plurality of second LEDs is a first plurality of second LEDs, wherein the plurality of light conditioning elements is a first plurality of light conditioning elements, the multiple mode light emitting device further comprising:

a second plurality of first LEDs and a second plurality of second LEDs on the LED portion, wherein the second plurality of first LEDs and the second plurality of second LEDs are arranged in a third ring that is centered about the central axis and is concentric with the first ring, wherein the second plurality of first LEDs emit the first type of light and the second plurality of second LEDs emit the second type of light, wherein the first LEDs of the second plurality of first LEDs and the second LEDs of the second plurality of second LEDs are alternating with each other along the third ring, wherein each first LED of the second plurality of first LEDs is aligned along one of the first plurality of radial lines, and wherein each second LED of the second plurality of second LEDs is aligned along one of the second plurality of radial lines; and a second plurality of light conditioning elements on the rotatable portion and arranged in a fourth ring centered about the central axis of the multiple mode light emitting device, wherein the fourth ring and the third ring have the same diameter, wherein rotation of the rotatable portion between the first and second positions rotates the second plurality of light conditioning elements relative to the second plurality of first LEDs and the second plurality of second LEDs, wherein each light conditioning element of the second plurality of light conditioning elements receives and conditions light from one first LED of the second plurality of first LEDs when the rotatable portion is in the first position, and wherein each light conditioning element of the second plurality of light conditioning elements receives and conditions light from one second LED of the second plurality of second LEDs when the rotatable portion is in the second position.

9. A multiple mode light emitting device, comprising:

a plurality of first LEDs arranged in a first ring centered about a central axis, wherein the plurality of first LEDs emit a first type of light of a first frequency, and wherein each first LED of the plurality of first LEDs is aligned along one of a first plurality of radial lines extending outwardly from the central axis;

a plurality of second LEDs arranged in the first ring, wherein the plurality of second LEDs emit a second type of light of a second frequency that is different from the first frequency, wherein the first LEDs of the plurality of first LEDs and the second LEDs of the plurality of second LEDs are alternating with each other along the first ring, wherein each second LED of the plurality of second LEDs is aligned along one of a second plurality of radial lines extending outwardly from the central axis, and wherein each second radial line is displaced from an adjacent first radial line by an angular displacement of Ø°;

a plurality of light conditioning elements arranged in a second ring centered about the central axis, wherein the second ring and the first ring have the same diameter, wherein each light conditioning element receives and conditions light from one first LED of the plurality of first LEDs when the plurality of light conditioning elements is aligned with the plurality of first LEDs, and wherein each light conditioning element receives and conditions light from one second LED of the plurality of second LEDs when the plurality of light conditioning elements is aligned with the plurality of second LEDs; and a rotatable portion including one of the plurality of first and second LEDs thereon or including the plurality of light conditioning elements thereon, wherein the rotatable portion is configured to rotate between a first position and a second position, wherein rotation of the rotatable portion between the first and second positions rotates the plurality of light conditioning elements and the plurality of first and second LEDs relative to each other, wherein the rotatable portion is rotated about the central axis by the angular displacement of Ø° to move between the first position in which the plurality of light conditioning elements is aligned with the plurality of first LEDs, and to the second position in which the plurality of light conditioning elements is aligned with the plurality of second LEDs.

10. The multiple mode light emitting device of claim 9, wherein the plurality of light conditioning elements comprises:

a plurality of reflector cups, wherein each reflector cup receives and reflects light from one first LED of the plurality of first LEDs when the rotatable portion is in the first position, and wherein each reflector cup receives and reflects light from one second LED of the plurality of second LEDs when the rotatable portion is in the second position.

11. The multiple mode light emitting device of claim 9, wherein the plurality of light conditioning elements comprises:

a plurality of lenses, wherein each lens receives and focuses light from one first LED of the plurality of first LEDs when the rotatable portion is in the first position, and wherein each lens receives and focuses light from one second LED of the plurality of second LEDs when the rotatable portion is in the second position.

12. The multiple mode light emitting device of claim 9, wherein the rotatable portion comprises the plurality of first LEDs and the plurality of second LEDs.

13. The multiple mode light emitting device of claim 9, wherein the angular displacement of Ø° is a first angular displacement $Ø°_1$, the multiple mode light emitting device further comprising:

a plurality of third LEDs arranged in the ring, wherein the plurality of third LEDs emit a third type of light of a third frequency that is different from the first frequency and the second frequency, wherein the first LEDs of the plurality of first LEDs, the second LEDs of the plurality of second LEDs, and the third LEDs of the plurality of third LEDs are alternating with each other along the first ring, wherein each third LED of the plurality of third LEDs is aligned along one of a third plurality of radial lines extending outwardly from the central axis, and wherein each third radial line is displaced from an adjacent second radial line by a second angular displacement of $Ø°_2$.

14. The multiple mode light emitting device of claim 9, wherein the plurality of first LEDs is a first plurality of first LEDs, wherein the plurality of second LEDs is a first plurality of second LEDs, wherein the plurality of light conditioning elements is a first plurality of light conditioning elements, the multiple mode light emitting device further comprising:

a second plurality of first LEDs arranged in a third ring centered about a central axis and concentric with the first ring, wherein each first LED of the second plurality of first LEDs is aligned along one of the first plurality of radial lines extending outwardly from the central axis;

a second plurality of second LEDs arranged in the third ring, wherein the first LEDs of the second plurality of first LEDs and the second LEDs of the second plurality of second LEDs are alternating with each other along the third ring, wherein each second LED of the second plurality of second LEDs is aligned along one of the second plurality of radial lines extending outwardly from the central axis;

a second plurality of light conditioning elements arranged in a fourth ring centered about the central axis, wherein the fourth ring and the third ring have the same diameter, wherein the second plurality of first and second LEDs or the second plurality of light condition elements are on the rotatable portion, and wherein rotation of the rotatable portion between the first and second positions rotates the second plurality of light conditioning elements and the second plurality of first and second LEDs relative to each other, wherein each light conditioning element of the second plurality of light conditioning elements receives and conditions light from one first LED of the second plurality of first LEDs the rotatable portion is in the first position, and wherein each light conditioning element of the second plurality of light conditioning elements receives and conditions light from one second LED of the second plurality of second LEDs when the rotatable portion is in the second position.

15. The multiple mode light emitting device of claim 9, further comprising:

a controller and actuator unit, wherein the controller and actuator unit determines when the plurality of first LEDs are powered, and rotates the rotatable portion to the first position in response to determining the plurality of first LEDs are powered, and wherein the controller and actuator unit determines when the plurality of second LEDs are powered, and rotates the rotatable portion to the second position in response to determining the plurality of second LEDs powered.

16. A method comprising:

rotating a rotatable portion of a light emitting device about a central axis by an angular displacement of Ø° when a plurality of first light emitting diodes (LEDs) of the light emitting device are powered and a plurality of second LEDs of the light emitting device are unpowered, wherein the rotation moves the rotatable portion to a first position, wherein the first LEDs of the plurality of first LEDs and the second LEDs of the plurality of second LEDs are arranged in an alternating manner in a first ring around the central axis, wherein the plurality of first LEDs emit a first type of light and the plurality of second LEDs emit a second type of light that is different from the first type of light, wherein each first LED the plurality of first LEDs is aligned along one of a first plurality of radial lines extending outwardly from the central axis, wherein each second LED of the plurality of second LEDs is aligned along one of a second plurality of radial lines extending outwardly from the central axis, and wherein each second radial line is displaced from an adjacent first radial line by an angular displacement of Ø°;

rotating the rotatable portion about the central axis by the angular displacement of Ø° when the plurality of second LEDs are powered and the plurality of first LEDs are unpowered, wherein the rotation moves the rotatable portion from the first position to the second position, wherein the rotatable portion comprises a plurality of light conditioning elements arranged in a second ring around the central axis, wherein rotating the rotatable portion between the first and second positions rotates the plurality of light conditioning elements relative to the plurality of first LEDs and the plurality of second LEDs, wherein each light conditioning element of the plurality of light conditioning elements receives and conditions light from one first LED of the plurality of first LEDs when the rotatable portion is in the first position, and wherein each light conditioning element of the plurality of light conditioning elements receives and conditions light emitted from one second LED of the plurality of second LEDs when the rotatable portion is in the second position.

17. The method of claim 16, wherein the rotatable portion is a reflector portion, wherein the plurality of light conditioning elements is a plurality of reflector cups, and wherein each reflector cup of the plurality of reflector cups are respectively aligned with a corresponding one of the plurality of first LEDs to reflect light emitted by the plurality of first LEDs when the rotatable portion is in the first position.

18. The method of claim 16, wherein the rotatable portion is a lens portion, wherein the plurality of light conditioning elements is a plurality of lenses, and wherein each of lens the plurality of lenses are respectively aligned with a corresponding first LED of the plurality of first LEDs to condition light emitted by the plurality of first LEDs when the rotatable portion is in the first position.

19. The method of claim 16, further comprising determining, with a controller, that the plurality of first LEDs are powered, wherein rotating the rotatable portion about the central axis by the angular displacement of Ø° when the plurality of first light emitting diodes (LEDs) are powered comprises controlling, with the controller, an actuator to rotate the rotatable portion in response to determining that the plurality of first LEDs are powered.

20. The method of claim 16, further comprising determining, with a controller, that the plurality of second LEDs are powered, wherein rotataing the rotatable portion by the angular displacement of Ø° when the plurality of second LEDs are powered and the plurality of first LEDs are unpowered comprises controlling, with the controller, an actuator to rotate the rotatable portion in response to determining that the plurality of second LEDs are powered.

* * * * *